United States Patent [19]

Anderson et al.

[11] 3,960,128

[45] June 1, 1976

[54] CAPACITOR DISCHARGE IGNITION SYSTEM

[75] Inventors: Harold E. Anderson, Los Angeles; Gerald T. Kiner, Lawndale, both of Calif.

[73] Assignee: McCulloch Corporation, Los Angeles, Calif.

[22] Filed: Oct. 15, 1974

[21] Appl. No.: 514,603

[52] U.S. Cl. ..... 123/148 E; 123/198 DC; 123/118

[51] Int. Cl.[2] ..... F02P 1/00

[58] Field of Search ..... 123/148 E, 148 MC, 118, 123/198 DB

[56] References Cited

UNITED STATES PATENTS

| | | | |
|---|---|---|---|
| 3,358,665 | 12/1967 | Carmichael et al. | 123/148 E |
| 3,405,347 | 10/1968 | Swift et al. | 123/148 MC |
| 3,524,438 | 8/1970 | Janisch | 123/148 MC |
| 3,545,420 | 12/1970 | Foreman et al. | 123/148 MC |
| 3,553,529 | 1/1971 | Strelow | 123/148 MC |
| 3,598,098 | 8/1971 | Sohner et al. | 123/148 MC |
| 3,661,132 | 5/1972 | Farr | 123/148 MC |
| 3,667,441 | 6/1972 | Cavil | 123/148 MC |
| 3,720,194 | 3/1973 | Mallory, Jr. | 123/148 MC |
| 3,722,488 | 3/1973 | Swift et al. | 123/148 MC |
| 3,809,044 | 5/1974 | Jereb et al. | 123/148 MC |
| 3,863,616 | 2/1975 | Wood | 123/118 |
| 3,894,524 | 7/1975 | Burkett | 123/148 MC |

*Primary Examiner*—Charles J. Myhre
*Assistant Examiner*—Ronald B. Cox
*Attorney, Agent, or Firm*—Burns, Doane, Swecker & Mathis

[57] ABSTRACT

A capacitor discharge ignition circuit in which charging, trigger and shutoff coils are wound as a single coil and disposed on one leg of a two-legged magnetic core.

7 Claims, 2 Drawing Figures

CAPACITOR DISCHARGE IGNITION SYSTEM

BACKGROUND OF THE INVENTION

The present invention is directed to a capacitor discharge ignition circuit for an internal combustion engine and more particularly to a capacitor discharge ignition circuit in which all of the operative coils are wound as a single coil for disposition on one leg of a magnetic core.

Capacitor discharge ignition circuits are well known. Such circuits generally include a charging coil in which is generated the current utilized to charge a storage capacitor and a trigger coil utilized to generate the current necessary to effect operation of an electronic switch in the discharge circuit of the capacitor. The discharge circuit of the capacitor includes the primary winding of a high voltage transformer so that the operation of the electronic switch to discharge the capacitor through the primary winding provides ionization potential across the air gap of an ignition device such as a spark plug for an internal combustion engine.

It is known in such capacitor discharge ignition circuits that the charging coil and trigger coil may be wound on the same leg of a magnetic core whereby the timing of the charging and discharging of the ignition capacitor may be controlled. It is also known that a third coil may be utilized to insure the operation of the electronic switch during the normal charging operation of the storage capacitor to thereby shunt charging current away from the capacitor. Such coils are generally termed "shutoff" coils and are selectively switched into the ignition circuit when it is desired to terminate the operation of the internal combustion engine. The use of such shutoff coils is, for example, disclosed and claimed in the pending U.S. application Ser. No. 370,371 filed June 15, 1973, now U.S. Pat. No. 3,894,524 for "Capacitor Discharge Ignition System" and assigned to the assignee of the present invention.

The provision of charging, trigger and shutoff coils may require three separate coil manufacturing operations as well as separate assemblying steps, and it is an object of the present invention to provide a capacitor discharge ignition circuit in which all of the operative coils are wound as two single coils for disposition on the same leg of a magnetic core. One of the two coils may be tapped intermediate the ends thereof to separate the control functions and a substantial reduction in the size and expense of the circuit as well as minimization of the assemblying process is achieved thereby.

These and other objects of the present invention will become apparent to one skilled in the art to which the invention pertains from a perusal of the following detailed description when read in conjunction with the appended drawings.

THE DRAWINGS

Figure 1:
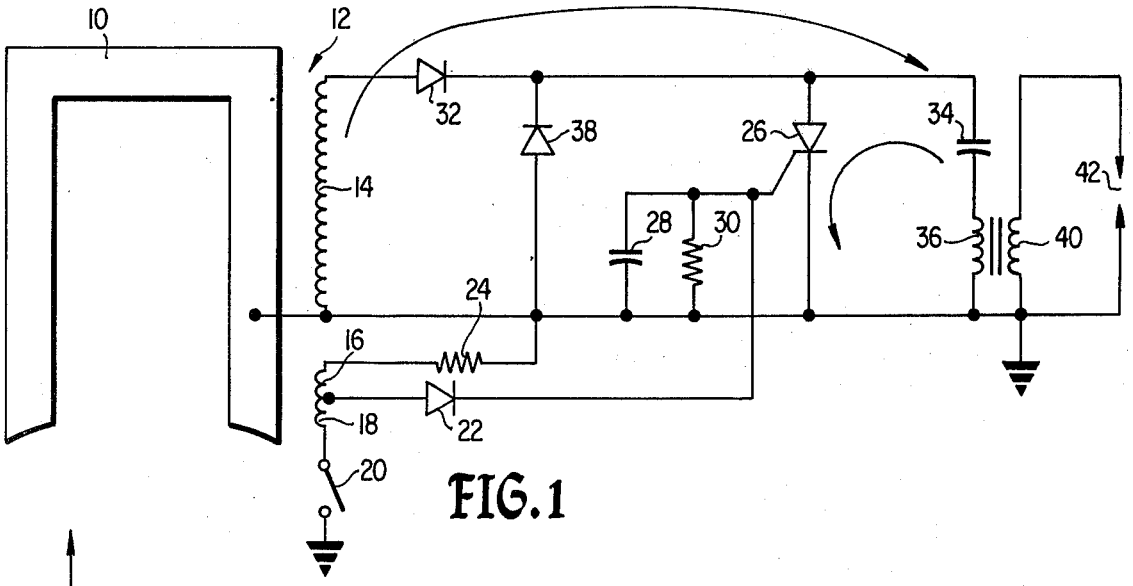
Figure 2:
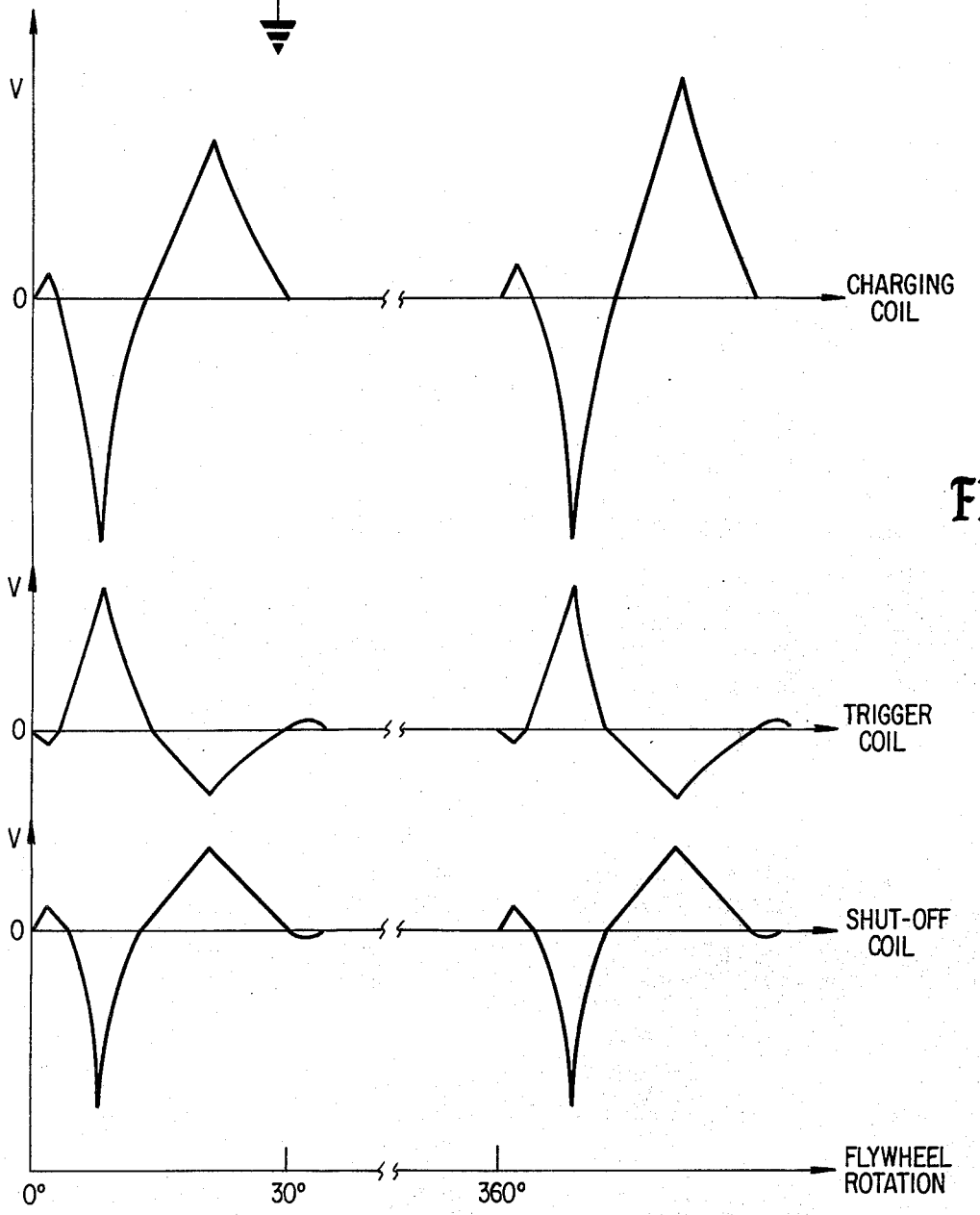

FIG. 1 is a schematic circuit diagram illustrating one embodiment of the present invention; and, FIG. 2 is a timing diagram for the waveforms generated in the circuit of FIG. 1.

THE DETAILED DESCRIPTION

With reference to FIG. 1 where a two-legged magnetic core 10 is illustrated, two coils 12 and 13 are wound about one leg thereof. The coil 13 may be easily converted into two separate coils 16 and 18 during the manufacturing process by the tapping thereof at a point intermediate the ends thereof. In FIG. 1, for example, the coil 12 may comprise 2,500 turns which are utilized as a charging coil 14 for the ignition circuit subsequently to be described. One hundred turns of the coil 13 may be utilized as the trigger coil 16 for the ignition circuit, and an additional 100 turns utilized as the shutoff coil 18 for the ignition circuit.

One end of the shutoff coil 18 may be connected through a suitable conventional manually operable switch 20 to ground and the tap between the trigger coil 16 and the shutoff coil 18 connected through a diode 22 to the gate electrode of a grounded cathode of an SCR 26. The gate electrode of the SCR 26 may also be grounded through the parallel combination of a capacitor 28 and a resistor 30.

The ungrounded end of the charging coil 14 may be connected through a diode 32 to the anode of the SCR 26 and to the series combination of the ignition capacitor 34 and the primary winding 36 of the ignition transformer. A diode 38 is connected across the SCR 26 for commmutating purposes.

The secondary winding 40 of the ignition transformer may be connected to the gap ignition device 42 such as a conventional spark plug of an internal combustion engine.

In operation, the flywheel responsive movement of a magnetic element into and out of proximity to the free ends of the core 10 will generate positive, negative and then positive impulses. The first positive impulse will be passed though the diode 32 but effects little charging of the storage capacitor 34 at speeds below about 8,000 r.p.m. The negative impulse will be blocked by the diode 32 and the second positive impulse, far larger in amplitude as shown in FIG. 2, will effect charging of the capacitor 34.

During this same time interval as shown in FIG. 2, negative, positive and then negative impulses will be generated within the trigger coil 16 followed by a smaller positive impulse effectively filtered by the capacitor 28 and resistor 30 to so effect. The negative impulses will be blocked by the diode 22 during the charging of the ignition capacitor 34 by the current generated within the charging coil 14 and the large positive impulse effects operation of the SCR 26.

As shown in FIG. 2, the impulses in the trigger coil 16 are 180 degrees out of phase with the impulses in the charging coil 14 and the next subsequent generation of a positive pulse in the trigger coil 16 after the capacitor 34 has been charged by the major positive pulse in the charging coil 14 will be passed through the diode 22 to the gate electrode of the SCR 26 thereby insuring the conduction thereof. The conduction of the SCR 26 provides a discharge path for the potential of the storage capacitor 34 and this discharge current is inductively coupled through the primary winding 36 and secondary winding 40 of the high voltage transformer to supply ignition potential to the ignition device 42.

During the normal operation of the circuit as above described, the switch 20 will remain in an open position thereby removing the shutoff coil 18 from the ignition circuit. In the event that engine shutoff is desired, the contacts of the switch 20 may be closed so that negative and then positive going impulses will be generated in the shutoff coil 18 in synchronism with the impulses generated in the charging coil 12 as illustrated in FIG. 2. The positive going impulses are larger in magnitude than the corresponding negative pulses of the trigger coil due to the resistance 24 in the trigger coil circuit.

These positive impulses will be passed through the diode 22 to the gate electrode of the SCR 26 to insure the conduction thereof during the time interval in which the charging coil 14 is seeking to charge the ignition capacitor 34. The conduction of the SCR during this time interval shunts current away from the capacitor 34 and prevents the accumulation thereon of sufficient charge to provide gas ionization potential to the ignition device 42.

Because all of the coils 14, 16 and 18 are wound on the same leg of the core 10, and because the trigger coil 16 and shutoff coil 18 induced currents are opposed in polarity, either the number of turns in the shutoff coil 18 must be at least as great as the number of turns in the trigger coil 16 to insure the conduction of the SCR 26 during the normal capacitor 34 charging cycle when engine shutoff is desired, or the impedance in the trigger coil circuit must be greater.

A significant advantage of both of the circuits as above described includes the removal of the engine shutoff means from the charging circuit. As is frequently the case where ignition circuits such as those herein disclosed are utilized in hostile environments such as portable chain saws, sawdust and/or other debris together with moisture may provide a shunt between the leads for the charging coil, particularly where these leads are exposed for connection to a mechanical shutoff switch. As the resistance of this shunt decreases, more of the current from the charging coil will be shunted away from the ignition capacitor. In the circuits of the present invention, the mechanical switch has been eliminated from the high voltage charging circuit and only the relatively low voltage of the relatively few turns of the shutoff coil will be subject to this shunt. Since the trigger current can be greatly reduced without inhibiting operation, and since the more critical high voltage charging coil is protected, operation of the circuit in a hostile environment is greatly enhanced.

An additional and very significant advantage is the simplicity of manufacture achieved by the present invention. A significantly less expensive circuit results as a result of both manufacturing and assemblying techniques.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An ignition circuit for an internal combustion engine comprising:

a two-legged magnetic member;

a capacitor;

a charging circuit including a first coil for periodically applying a unidirectional charging current to said capacitor responsively to engine rotation;

a discharge circuit for said capacitor, said discharge circuit including the primary winding of an ignition transformer and an SCR connected in series;

a trigger circuit including a first plurality of turns of a second coil for periodically applying a triggering potential to the gate of said SCR responsively to engine rotation; and, selectively operable means including a second plurality of turns of said second coil for periodically applying a triggering potential to the gate of said SCR in sufficient synchronism to prevent charging of said capacitor to ignition potential, said first and second coils being unidirectionally wound on one leg of said two-legged magnetic member.

2. The circuit of claim 1 wherein the number of turns in said second plurality of turns of said second coil is greater than the number of turns in said first plurality of turns of said second coil.

3. The circuit of claim 1 wherein the impedance of said trigger circuit is greater than the impedance of the circuit of said selectively operable means.

4. An ignition circuit for an internal combustion engine comprising:

a capacitor;

means including a first plurality of coil turns for periodically applying a unidirectional current to said capacitor responsively to engine rotation;

a discharge circuit for said capacitor, said discharge circuit including the primary winding of an ignition transformer in series with electronic switch means;

means including a second plurality of coil turns for periodically applying a triggering potential to said switch means responsively to engine rotation; and means including a third plurality of coil turns for opposing the application of triggering potential to said switch means, said second and third pluralities of coil turns comprising turns of a single coil.

5. The ignition circuit of claim 4 wherein said electronic switch is an SCR;

wherein said second plurality of turns is connected to the gate of said SCR through a resistive element; and, wherein said third plurality of turns is connected to the gate of said SCR.

6. The ignition circuit of claim 4 wherein the number of turns in said third plurality of turns is greater than the number of turns in said second plurality of turns.

7. A method of providing all of the operative coils of a capacitor discharge ignition circuit including an ignition capacitor and an electronic switch, said method comprising the steps of:

a. providing a two-legged magnetic core;

b. winding a first coil for subsequent electrical connection to the ignition capacitor;

c. winding a first plurality of turns of a second coil on the same core for subsequent electrical connection to the control electrode of the electronic switch, the number of turns in the first plurality of turns being at least an order of magnitude less than the number of turns in the first coil;

d. winding a second plurality of turns of the second coil for subsequent electrical connection to the control electrode of the electronic switch out of phase with the first plurality of turns, the number of turns in the second plurality of turns being at least an order of magnitude less than the number of turns of the first coil and at least equal to the number of turns in the first plurality of turns; and, e. disposing the first and second coils on the same leg of a two-legged magnetic core.

* * * * *